US008816801B2

(12) United States Patent
Tachikawa et al.

(10) Patent No.: US 8,816,801 B2
(45) Date of Patent: Aug. 26, 2014

(54) CONTACT MECHANISM AND ELECTROMAGNETIC CONTACTOR USING THE SAME

(75) Inventors: Hiroyuki Tachikawa, Yokohama (JP); Masaru Isozaki, Ichihara (JP); Osamu Kashimura, Hino (JP); Kouetsu Takaya, Kounosu (JP); Yasuhiro Naka, Kounosu (JP); Yuji Shiba, Kounosu (JP)

(73) Assignees: Fuji Electric Co., Ltd., Kawasaki-shi (JP); Fuji Electric FA Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 13/878,353

(22) PCT Filed: May 9, 2012

(86) PCT No.: PCT/JP2012/003040

§ 371 (c)(1),
(2), (4) Date: May 23, 2013

(87) PCT Pub. No.: WO2012/157215

PCT Pub. Date: Nov. 22, 2012

(65) Prior Publication Data

US 2013/0335175 A1 Dec. 19, 2013

(30) Foreign Application Priority Data

May 19, 2011 (JP) ..... 2011-112910

(51) Int. Cl.

| | |
|---|---|
| ***H01H 53/00*** | (2006.01) |
| ***H01H 1/54*** | (2006.01) |
| ***H01H 3/22*** | (2006.01) |
| ***H01H 50/54*** | (2006.01) |
| ***H01H 9/44*** | (2006.01) |

(52) U.S. Cl.

CPC ..... *H01H 3/222* (2013.01); *H01H 1/54* (2013.01); *H01H 50/546* (2013.01); *H01H 9/443* (2013.01); *H01H 2001/545* (2013.01)

USPC ..... 335/147; 335/131

(58) Field of Classification Search

USPC ..... 335/147

See application file for complete search history.

(56) References Cited

U.S. PATENT DOCUMENTS

| | | | | |
|---|---|---|---|---|
| 5,495,220 | A * | 2/1996 | Takaya et al. | 335/274 |
| 6,111,488 | A * | 8/2000 | Nakamura et al. | 335/132 |
| 2004/0066261 | A1 | 4/2004 | Nishida et al. | |
| 2009/0237191 | A1 | 9/2009 | Yano et al. | |
| 2009/0315653 | A1 * | 12/2009 | Suzuki et al. | 335/185 |

FOREIGN PATENT DOCUMENTS

| | | | |
|---|---|---|---|
| JP | H04-123719 | A | 4/1992 |
| JP | 2001-210170 | A | 8/2001 |
| JP | 2004-071512 | A | 3/2004 |
| JP | 2007-305468 | A | 11/2007 |

* cited by examiner

*Primary Examiner* — Shawki S Ismail
*Assistant Examiner* — Lisa Homza
(74) *Attorney, Agent, or Firm* — Manabu Kanesaka

(57) ABSTRACT

A contact mechanism where a shape of at least one of a fixed contactor including a pair of fixed contact portions and a movable contactor including a pair of movable contact portions capable of contacting with and separating from the pair of fixed contact portions is set to a shape that generates a Lorentz force resisting electromagnetic repulsion in a contactor opening direction generated between the fixed contact portions and the movable contact portions when a current is applied, has the fixed contactor and the movable contactor being inserted in a current path. Magnetic bodies are disposed on at least one of the fixed contactor and the movable contactor for suppressing a force driving arcs, which are generated between the pair of fixed contact portions and the pair of movable contact portions, to the fixed contactor on the opposite side.

6 Claims, 6 Drawing Sheets

CONTACT MECHANISM AND ELECTROMAGNETIC CONTACTOR USING THE SAME

RELATED APPLICATIONS

The present application is National Phase of International Application No. PCT/JP2012/003040 filed May 9, 2012, and claims priority from Japanese Application No. 2001-112910, filed May 19, 2011.

TECHNICAL FIELD

The present invention relates to a contact mechanism that includes a fixed contactor and a movable contactor inserted in a current path, and an electromagnetic contactor using the contact mechanism, and to a contact mechanism that is adapted to generate a Lorentz force resisting electromagnetic repulsion separating a movable contactor, to which a current has been applied, from the fixed contactor.

BACKGROUND ART

In the past, the following switch has been proposed as a contact mechanism that opens and closes a current path. The switch has a structure where a fixed contactor is bent in C shape when seen in side view, fixed contacts are formed at bent portions, and movable contacts of a movable contactor are provided so as to be capable of contacting with and separating from the fixed contacts, as a fixed contactor that is applied to a switch where an arc is generated at the time of the interruption of a current, such as a circuit breaker or an electromagnetic contactor. The switch rapidly extends an arc by increasing contact opening speed through the increase of electromagnetic repulsion that acts on the movable contactor at the time of the interruption of a large current (for example, see Patent Document 1).

Further, there has been proposed a contactor structure of an electromagnetic contactor that drives an arc by a magnetic field that is generated by a current flowing in the same structure (for example, see Patent Document 2).

CITATION LIST

Patent Document

Patent Document 1: Japanese Publication Number JP 2001-210170 A

Patent Document 2: Japanese Publication Number JP H4-123719 A

DISCLOSURE OF THE INVENTION

Problem to be Solved by the Invention

Meanwhile, in the related art disclosed in Patent Document 1, the fixed contactor is formed in a C shape when seen in side view so that electromagnetic repulsion to be generated is large. The contact opening speed of the movable contactor, when a large current is interrupted due to a short circuit or the like, is increased by this large electromagnetic repulsion and an arc is rapidly extended, so that it is possible to limit an accidental current to a small value.

However, an electromagnetic contactor, of which a circuit is formed by the combination of fuses or circuit breakers, needs to prevent the movable contactor from being opened by electromagnetic repulsion when a large current flowing at the time of a short circuit is applied. Generally, a spring force of a contact spring, which ensures contact pressure between the movable contactor and the fixed contactor, is increased to apply the related art disclosed in the above-mentioned Patent Document 2 to the electromagnetic contactor.

If the contact pressure generated by the contact spring is increased as described above, a thrust generated by an electromagnet, which drives the movable contactor, also need to be increased. For this reason, the size of the entire structure is increased. Alternatively, there is an unsolved problem in that fuses or circuit breakers having high current limiting effect and excellent breaking performance need to be combined.

In order to solve this unsolved problem, it is considered that the shape of at least one of the fixed contactor and the movable contactor is set to a shape that increases a Lorentz force resisting electromagnetic repulsion in a contactor opening direction generated between the fixed contactor and the movable contactor when a current is applied.

In this case, it is possible to suppress the electromagnetic repulsion in the contact opening direction by increasing a Lorentz force that resists the electromagnetic repulsion in the contact opening direction generated between the fixed contactor and the movable contactor when a current is applied. However, when a current is interrupted, an arc is generated between the fixed contactor and the movable contactor and this arc is extended in a direction orthogonal to a direction between the fixed contactor and the movable contactor by the Lorentz force. For this reason, there is a new problem in that the extinction of an arc is affected.

Accordingly, the invention has been made in consideration of the unsolved problem in the related art, and an object of the invention is to provide a contact mechanism that can suppress electromagnetic repulsion opening a movable contactor at the time of the application of a current without the increase of the size of the entire structure and is adapted to improve arc-extinguishing performance, and an electromagnetic contactor using the contact mechanism.

Means for Solving Problem

In order to achieve the above-mentioned object, in a contact mechanism according to an aspect of the invention, the shape of at least one of a pair of fixed contactors that includes a pair of fixed contactors and a movable contactor that can contact with and separate from the pair of fixed contactors is set to a shape that generates a Lorentz force resisting electromagnetic repulsion in a contactor opening direction generated between the fixed contactors and the movable contactor when a current is applied, and the pair of fixed contactors and the movable contactor are inserted in a current path. Magnetic bodies suppressing a force driving arcs, which are generated between the pair of fixed contactors and contact portions of the movable contactor, to the fixed contactors on the opposite side are disposed on at least one of the pair of fixed contactors and the movable contactor.

According to this structure, the shape of at least one of the fixed contactors and the movable contactor is set to, for example, an L shape or a C shape, that is, a shape that generates a Lorentz force resisting electromagnetic repulsion in a contactor opening direction generated between the fixed contactors and the movable contactor when a current is applied. Accordingly, it is possible to suppress the opening of the movable contactor when a large current is applied, and to suppress a force driving an arc to the fixed contactors on the opposite side by the magnetic bodies that are disposed on at least one of the fixed contactors and the movable contactor.

Further, in a contact mechanism according to another aspect of the invention, the movable contactor includes a conductive plate that is supported by a movable portion and includes contact portions at both end portion thereof on one of the surface and the back thereof, respectively, the fixed contactors include L-shaped conductive plate portions that include a pair of fixed contact portions, first conductive plate portions, and second conductive plate portions, the pair of fixed contact portions faces the contact portions of the conductive plate, the first conductive plate portions support the pair of fixed contact portions and extend toward the outside of both ends of the conductive plate in parallel with the conductive plate, and the second conductive plate portions extend from outer end portions of the first conductive plate portions while passing by the outside of end portions of the conductive plate. The magnetic bodies are disposed so as to cover at least portions of the second conductive plate portions that face the fixed contact portions.

According to this structure, with respect to the movable contactor that is formed of the conductive plate, L-shaped conductive portions are formed at the fixed contactors by the first conductive plate portion and the second conductive plate portion, and a large Lorentz force in a direction, where the movable contactor comes into contact with the fixed contactors, is generated against the electromagnetic repulsion in the contact opening direction generated between the fixed contactors and the movable contactor at the time of the application of a current, from the relation between a current flowing in the first conductive plate portions and the magnetic flux formed by the second conductive plate portions at the time of application of a current. Further, it is possible to suppress a force, which drives an arc to the fixed contactors on the opposite side, by the magnetic bodies disposed on the second conductive plate portions.

Furthermore, in a contact mechanism according to another aspect of the invention, the fixed contactors include third conductive plate portions that extend inward from end portions of the second conductive plate portions in parallel with the conductive plate, and are formed in a C shape. The magnetic bodies are disposed so as to cover at least inner surfaces of the second conductive plate portions.

According to this structure, currents of which the flow directions are opposite to each other flow in the first and third conductive plate portions. Accordingly, it is possible to generate electromagnetic repulsion, which makes the movable contactor contact with the fixed contactors, between the third conductive plate portions of the fixed contactors and the conductive plate of the movable contactor. Moreover, it is possible to suppress a force driving arcs, which are generated between the fixed contactors and the movable contactor, to the fixed contactors on the opposite side by the magnetic bodies disposed on the second conductive plate portions.

Further, in a contact mechanism according to another aspect of the invention, the movable contactor includes a conductive plate portion that is supported by a movable portion, C-shaped bent portions that are formed at both ends of the conductive plate portion, and contact portions that are formed on the surface of the conductive plate portion facing the C-shaped bent portions; the fixed contactors include L-shaped conductive plate portions that include a pair of first conductive plate portions and second conductive plate portions, contact portions, which come into contact with the contact portions of the movable contactor provided in the C-shaped bent portions in parallel with the conductive plate portion, are formed on the pair of first conductive plate portions, and the second conductive plate portions extend from inner ends of the pair of first conductive plate portions while passing by the inside of end portions of the C-shaped bent portions, respectively; and the magnetic bodies are disposed so as to cover at least inner surfaces of the C-shaped bent portions of the movable contactor.

According to this structure, the C-shaped bent portions are formed at the movable contactor, and electromagnetic repulsion in a direction where the movable contactor comes into contact with the fixed contactors is generated between the conductive plate portion of the movable contactor and the first conductive plate portions of the fixed contactors by using a current path on the C-shaped bent portions. Further, it is possible to suppress a force driving arcs, which are generated between the fixed contactors and the movable contactor, to the fixed contactors on the opposite side by the magnetic bodies that are disposed on the C-shaped bent portions.

Furthermore, an electromagnetic contactor according to an aspect of the invention includes the contact mechanism according to any one of the respective aspects, and the movable contactor is connected to a movable iron core of an operating electromagnet and the fixed contactors are connected to an external connection terminal.

According to this structure, since a Lorentz force, which resists electromagnetic repulsion that separates the movable contactor from the fixed contactors when a current is applied to the electromagnetic contactor, is generated, it is possible to reduce a spring force of a contact spring that makes the movable contactor come into contact with the fixed contactors. According to this, it is also possible to reduce a thrust of an electromagnet that drives the movable contactor, so that it is possible to provide a small electromagnetic contactor. Moreover, it is possible to suppress a force driving arcs, which are generated between the fixed contactors and the movable contactor, to the fixed contactors on the opposite side, by the magnetic bodies.

Effect of the Invention

According to the invention, it is possible to generate a Lorentz force that resists electromagnetic repulsion in a contact opening direction generated by a fixed contactor and a movable contactor when a large current is applied to a contact mechanism including the fixed contactors and the movable contactor inserted in a current path. For this reason, it is possible to reliably prevent the movable contactor from being opened at the time of the application of a large current without using a mechanical pressing force. Further, it is possible to improve arc-extinguishing performance by disposing magnetic bodies, which suppress a force driving arcs that are generated between the fixed contactors and contact portions of the movable contactor, to the fixed contactors on the opposite side, on at least one of the fixed contactor and the movable contactor.

BEST MODE(S) FOR CARRYING OUT THE INVENTION

Embodiments of the invention will be described below with reference to the drawings.

Figure 1:
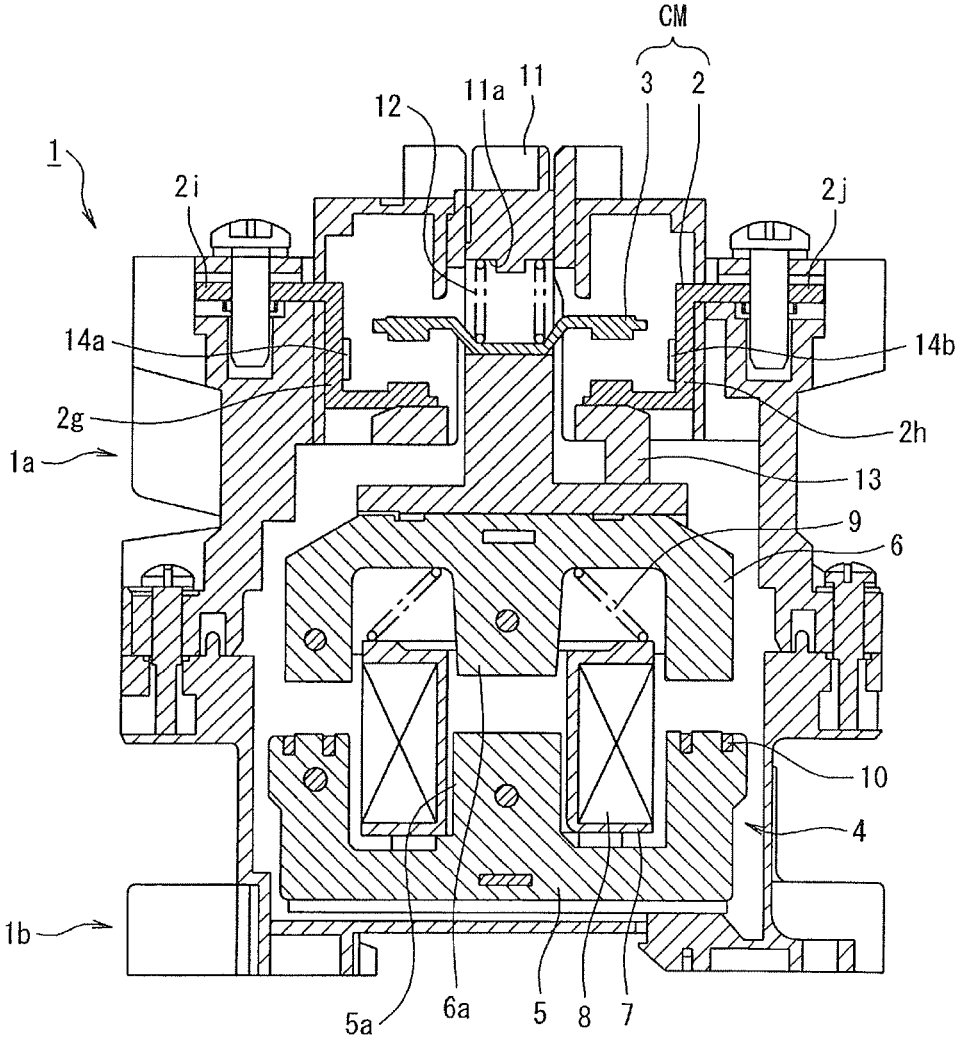
FIG. 1 is a cross-sectional view illustrating a first embodiment when the invention is applied to an electromagnetic contactor.
Figure 2A:
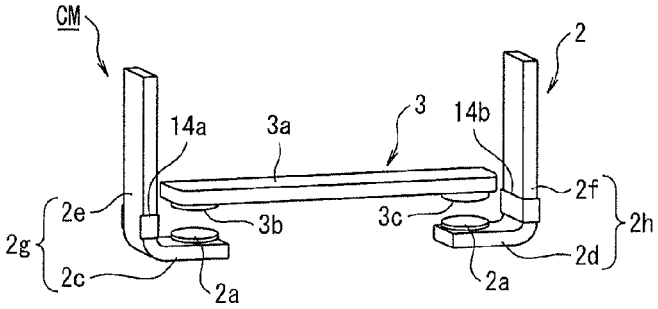
FIGS. 2(*a*)-2(*e*) are views illustrating the first embodiment of a contact mechanism of the invention, wherein FIG. 2(*a*) is a perspective view of the contact mechanism when a contact is opened, FIG. 2(*b*) is a perspective view of the contact mechanism when a contact is closed, FIG. 2(*c*) is a cross-sectional view illustrating magnetic flux when a contact is closed, FIG. 2(*d*) is a cross-sectional view illustrating an arc generating state of the contact mechanism when a contact is opened, and FIG. 2(*e*) is a view illustrating a magnetic field in a cross-sectional view taken along line A-A of FIG. 2(*d*).
Figure 2B:
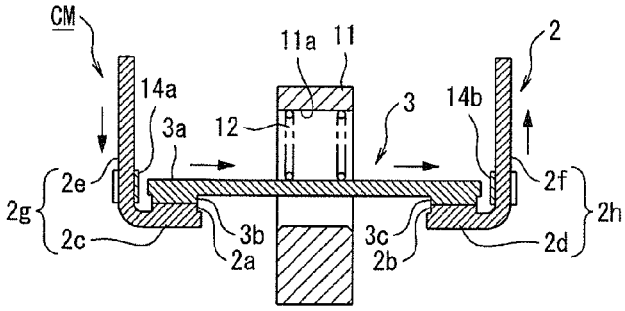
Figure 2C:
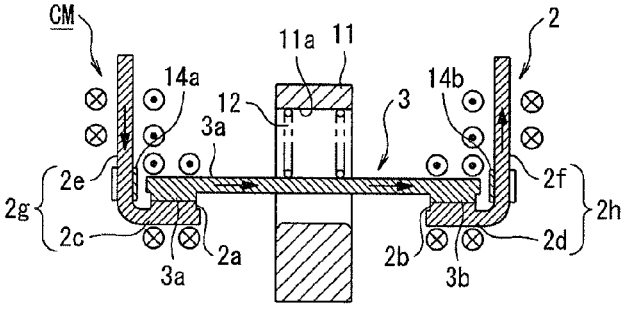
Figure 2D:
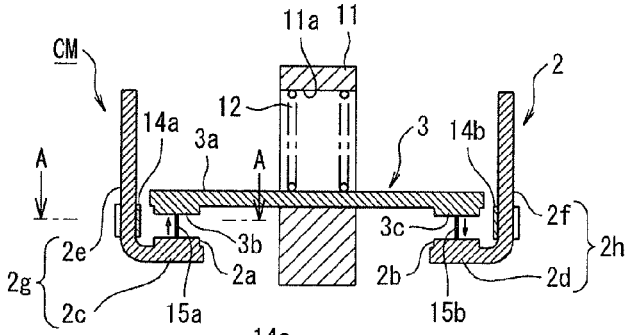
Figure 2E:
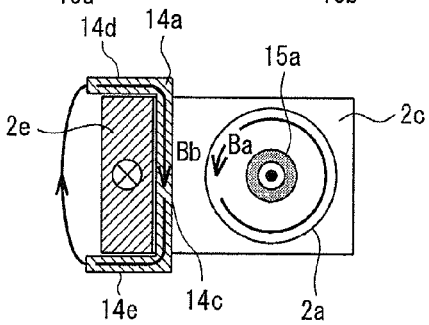

FIG. 1 is a cross-sectional view of an electromagnetic contactor to which a contact mechanism according to the invention is applied.

In FIG. 1, numeral 1 denotes a body case made of, for example, a synthetic resin. The body case 1 has a structure that is divided to two pieces, that is, an upper case 1*a* and a lower case 1*b*. A contact mechanism CM is provided in the upper case 1*a*. The contact mechanism CM includes a fixed contactor 2 that is fixedly disposed in the upper case 1*a* and a movable contactor 3 that is provided so as to be capable of contacting with and separating from the fixed contactor 2.

Further, the lower case 1*b* is provided with an operating electromagnet 4 that drives the movable contactor 3. The operating electromagnet 4 includes a fixed iron core 5 and a movable iron core 6 that are disposed so as to face each other. The fixed iron core 5 is formed of an E-shaped leg type laminated steel plate, and the movable iron core 6 is formed of an E-shaped leg type laminated steel plate.

An electromagnetic coil 8 which is wound around a coil holder 7 and to which a single-phase alternating current is supplied is fixed to a middle leg portion 5*a* of the fixed iron core 5. Moreover, a return spring 9, which urges the movable iron core 6 in the direction where the movable iron core 6 is separated from the fixed iron core 5, is provided between the upper surface of the coil holder 7 and the base of a middle leg 6*a* of the movable iron core 6.

In addition, shading coils 10 are embedded into the upper end faces of outer leg portions of the fixed iron core 5. It is possible to suppress noise, vibration, and the variation of an electromagnetic attractive force, which are caused by the change of alternating magnetic flux of a single-phase AC electromagnet, by the shading coils 10.

Further, a contactor holder 11 is connected to the upper end of the movable iron core 6. The movable contactor 3 is held and pressed downward in an insertion hole 11*a*, which is formed at the upper end portion of the contactor holder 11 in a direction perpendicular to an axis, so that a predetermined contact pressure against the fixed contactor 2 is obtained by a contact spring 12.

As enlarged in FIGS. 2(*a*)-2(*e*), a middle portion of the movable contactor 3 is formed of a slender bar-shaped conductive plate 3*a* that is pressed by the contact spring 12, and movable contact portions 3*b* and 3*c* are formed on the lower surfaces of both end portions of the conductive plate 3*a*, respectively.

Meanwhile, as enlarged in FIGS. 2(*a*)-(2*e*), the fixed contactor 2 includes L-shaped conductive plate portions 2*g* and 2*h*. The conductive plate portions 2*g* and 2*h* include first conductive plate portions 2*c* and 2*d* and second conductive plate portions 2*e* and 2*f*, respectively. The first conductive plate portions 2*c* and 2*d* support a pair of fixed contact portions 2*a* and 2*b*, which faces the movable contact portions 3*b* and 3*c* of the movable contactor 3 from below, and extends toward the outside in parallel with the conductive plate 3*a*. The second conductive plate portions 2*e* and 2*f* extend upward from the outer end portions of the first conductive plate portions 2*c* and 2*d*, which are positioned on the outside of the conductive plate 3*a*, while passing by the outside of the end portions of the conductive plate 3*a*. Further, the upper ends of the L-shaped conductive plate portions 2*g* and 2*h* are connected to external connection terminals 2*i* and 2*j* that extend toward the outside of the upper case 1*a* and are fixed to the upper case as illustrated in FIG. 1.

Furthermore, magnetic bodies (magnetic plates) 14*a* and 14*b* are fixedly disposed on the second conductive plate portions 2*e* and 2*f* of the L-shaped conductive plate portions 2*g* and 2*h*. The magnetic plates 14*a* and 14*b* include inner surface plate portions 14*c* and side plate portions 14*d* and 14*e*, respectively. The inner surface plate portions 14*c* cover the inner surfaces of the second conductive plate portions facing gaps between the fixed contact portions 2*a* and 2*b* and the movable contact portions 3*b* and 3*c* when the contact mechanism CM is in a contact opening state. The side plate portions 14*d* and 14*e* extend toward the outer surfaces of the second conductive plate portions from both front and rear ends of the inner surface plate portions 14*c* while passing by side surfaces of the second conductive plate portions 2*e* and 2*f*.

Next, the operation of the first embodiment will be described.

Now, when the electromagnetic coil 8 of the operating electromagnet 4 is in a non-excited state, an electromagnetic attractive force is not generated between the fixed iron core 5 and the movable iron core 6, the movable iron core 6 is urged by the return spring 9 in the direction where the movable iron core 6 is separated upward from the fixed iron core 5, and the upper end of the movable iron core 6 contacts with a stopper 13, so that the movable iron core 6 is held at a current interrupting position.

When the movable iron core 6 is in the current interrupting position, the movable contactor 3 contacts with the bottom portion of the insertion hole 11*a* of the contactor holder 11 due to the contact spring 12 as illustrated in FIG. 2(*a*). In this state, the movable contact portions 3*b* and 3*c* formed at both end portions of the conductive plate 3*a* of the movable contactor 3 are separated upward from the fixed contact portions 2*a* and 2*b* of the fixed contactor 2. Accordingly, the contact mechanism CM is in a contact opening state.

When a single-phase alternating current is supplied to the electromagnetic coil 8 of the operating electromagnet 4 from the contact opening state of the contact mechanism CM, an attractive force is generated between the fixed iron core 5 and the movable iron core 6, and the movable iron core 6 is attracted downward against the return spring 9. Accordingly, the movable contactor 3 supported by the contactor holder 11 is moved down and the movable contact portions 3*b* and 3*c* contact with the fixed contact portions 2*a* and 2*b* of the fixed contactor 2 with the contact pressure of the contact spring 12, so that the contact mechanism is in a contact closing state.

When the contact mechanism is in a contact closing state, a large current of about, for example, several tens kA to be input from the external connection terminal 2*i* of the fixed contactor 2 connected to, for example, a DC power source (not illustrated) is supplied to the movable contact portion 3*b* of the movable contactor 3 through the second conductive plate portion 2*e*, the first conductive plate portion 2*c*, and the fixed contact portion 2*a*. The large current supplied to the movable contact portion 3*b* is supplied to the fixed contact portion 2*b* through the conductive plate 3*a* and the movable contact portion 3*c*. A current path along which the large current supplied to the fixed contact portion 2*b* is supplied to the first conductive plate portion 2*d*, the second conductive plate portion 2*f*, and the external connection terminal 2*j* and supplied to an external load is formed.

At this time, electromagnetic repulsion in the direction where the movable contact portions 3*b* and 3*c* are opened is generated between the fixed contact portions 2*a* and 2*b* of the fixed contactor 2 and the movable contact portions 3*b* and 3*c* of the movable contactor 3.

However, since the L-shaped conductive plate portions 2*g* and 2*h* of the fixed contactor 2 include the first conductive plate portions 2*c* and 2*d* and the second conductive plate portions 2*e* and 2*f* as illustrated in FIGS. 2(*a*)-2(*e*), the above-mentioned current path is formed. Accordingly, a magnetic field illustrated in FIG. 2(*c*) is generated by a current flowing in the movable contactor 3. For this reason, it is possible to make a Lorentz force, which resists electromagnetic repulsion in a contact opening direction, which presses the movable contact portions 3*b* and 3*c* against the fixed contact portions 2*a* and 2*b*, act on the conductive plate 3*a* of the movable contactor 3 according to Fleming's left-hand rule.

Accordingly, even though electromagnetic repulsion in the direction where the movable contactor 3 is opened is generated, it is possible to generate a Lorentz force that resists the electromagnetic repulsion. Therefore, it is possible to reliably suppress the opening of the movable contactor 3. For this reason, it is possible to reduce the pressing force of the contact spring 12 supporting the movable contactor 3. Accordingly, it is also possible to reduce a thrust that is generated by the operating electromagnet 4 and to reduce the size of the entire structure.

Moreover, in this case, only the L-shaped conductive plate portions 2*g* and 2*h* may be formed at the fixed contactor 2, it is possible to easily machine the fixed contactor 2, and a separate member, which generates an electromagnetic force or a mechanical force resisting electromagnetic repulsion in the contact opening direction, is not required. Accordingly, it is possible to suppress the increase of the size of the entire structure without the increase of the number of parts.

When the excitation of the operating electromagnet 4 is stopped from the contact closing state of the contact mechanism CM and a current is interrupted, the movable contact portions 3*b* and 3*c* of the movable contactor 3 are separated upward from the fixed contact portions 2*a* and 2*b* of the L-shaped conductive plate portions 2*g* and 2*h* of the fixed contactor 2 as illustrated in FIG. 2(*d*). At this time, arcs 15*a* and 15*b* are generated between the fixed contact portions 2*a* and 2*b* and the movable contact portions 3*b* and 3*c*. The current direction of the arc 15*a* corresponds to the contact opening direction, and the current direction of the arc 15*b* corresponds to a direction opposite to the contact opening direction.

If the external connection terminal 2*i* is connected to a positive (+) electrode terminal and the external connection terminal 2*j* is connected to a negative (−) electrode terminal at this time, the L-shaped conductive plate portion 2*g* of the fixed contactor 2 has a positive polarity and the L-shaped conductive plate portion 2*h* has a negative polarity. As a result, the current direction of the arc 15*a*, which is generated between the fixed contact portion 2*a* of the L-shaped conductive plate portion 2*g* and the movable contact portion 3*b* of the movable contactor 3, corresponds to a direction that is directed to the movable contact portion 3*b* from the fixed contact portion 2*a* as illustrated in FIG. 2(*e*). Further, the direction of a current flowing in the second conductive plate portion 2*e* adjacent to the arc 15*a* corresponds to an opposite direction.

Figure 3A:
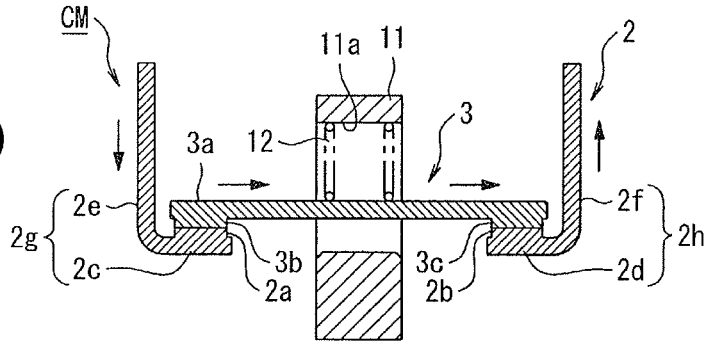
FIGS. 3(*a*)-3(*c*) are views illustrating the contact mechanism from which magnetic bodies have been removed, wherein FIG. 3(*a*) is a cross-sectional view of the contact mechanism when a contact is closed, FIG. 3(*b*) is a cross-sectional view illustrating an arc generating state of the contact mechanism when a contact is opened, and FIG. 3(*c*) is a view illustrating a magnetic field in a cross-sectional view taken along line B-B of FIG. 3(*b*).
Figure 3B:
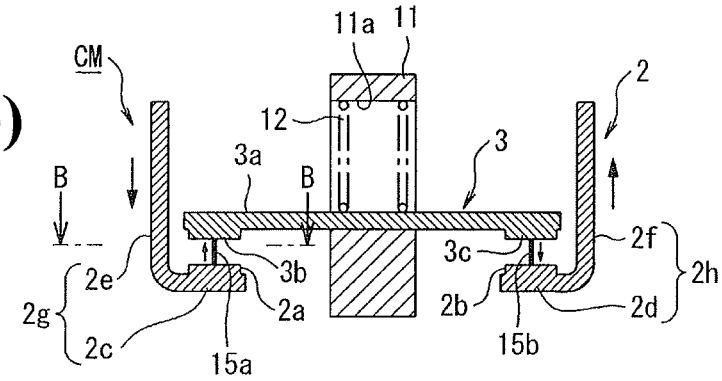
Figure 3C:
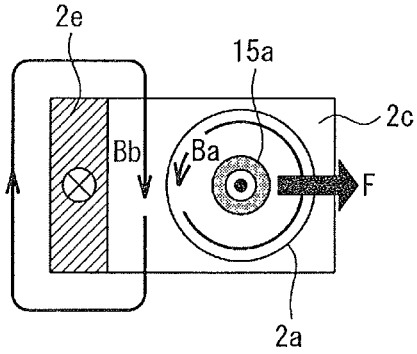

For this reason, magnetic fields, which are generated by the arc 15*a* and the second conductive plate portion 2*e*, are generated in the directions where the magnetic fields repel each other. Accordingly, if the magnetic plates 14*a* and 14*b* are omitted as illustrated in FIG. 3(*a*), arc ends of the arc 15*a* are moved toward the inside, that is, toward the second conductive plate portion 2*f* due to the influence of the electromagnetic repulsion. Therefore, a space sufficient for the interruption of an arc is not obtained, so that it is difficult to sufficiently extend an arc and to interrupt the arc.

However, in this embodiment, as illustrated in FIG. 2(*e*), the magnetic plate 14*a* is disposed so as to cover the inner surface of the second conductive plate portion 2*e* of the L-shaped conductive plate portion 2*g* that faces the gap between the fixed contact portion 2*a* and the movable contact portion 3*b* in which the arc 15*a* is generated. For this reason, since it is possible to shield a magnetic field, which is generated by the second conductive plate portion 2*e*, by the magnetic plate 14*a*, it is possible to prevent the magnetic field, which is generated by the second conductive plate portion 2*e*, from affecting the arc 15*a*.

Likewise, since the magnetic plate 14*b* is disposed even on the second conductive plate portion 2*f* of the L-shaped conductive plate portion 2*h* adjacent to the arc 15*b*, which is generated between the fixed contact portion 2*b* and the movable contact portion 3*c*, so as to cover the inner surface of the second conductive plate portion, it is possible to shield a magnetic field, which is generated by the second conductive plate portion 2*f*, by the magnetic plate 14*a*. Accordingly, it is possible to prevent the magnetic field from affecting the arc 15*b*.

Therefore, since it is possible to reduce the influence of the magnetic fields generated from the second conductive plate portions 2*e* and 2*f* without making the second conductive plate portions 2*e* and 2*f* of the L-shaped conductive plate portions 2*g* and 2*h*, which are adjacent to the arcs 15*a* and 15*b*, be distant from the arcs 15*a* and 15*b*, it is possible to stably extend the arcs 15*a* and 15*b* in an aimed direction and to interrupt the arcs without increasing the size of a device.

That is, it is possible to reliably interrupt the arcs 15*a* and 15*b* by applying an external magnetic field so that the arcs 15*a* and 15*b* are moved in a direction perpendicular to the current direction on the conductive plate 3*a* of the movable contactor 3 and by giving an interruption space sufficient for the interruption of the arcs 15*a* and 15*b* in this direction perpendicular to the current direction.

Incidentally, if the magnetic plates 14*a* and 14*b* are not provided on the second conductive plate portions 2*e* and 2*f* of the L-shaped conductive plate portions 2*g* and 2*h* of the fixed contactor 2 as illustrated in FIGS. 3(*a*) and 3(*b*), it is possible to generate a Lorentz force suppressing the electromagnetic repulsion in the contact opening direction as in the above-mentioned first embodiment when the contact mechanism CM is in a contact closing state as illustrated in FIG. 3(*a*). However, when the arcs 15*a* and 15*b* are generated as illustrated in FIG. 3(*b*) at the time of the interruption of a current, a magnetic field having clockwise magnetic flux Bb is formed around the L-shaped conductive plate portion 2*g* by a current flowing in the second conductive plate portion 2*e* of the L-shaped conductive plate portion 2*g* as illustrated in FIG. 3(*c*). Meanwhile, since the current direction corresponds to an opposite direction in the arc 15*a*, a magnetic field having counterclockwise magnetic flux Ba is formed around the arc 15*a*.

For this reason, the magnetic field formed by the current flowing in the second conductive plate portion 2*e* and the magnetic field formed by the current flowing in the arc 15*a* repel each other, and a force F, which moves the arc ends to the right side in FIG. 3(*c*), that is, toward the opposite L-shaped conductive plate portion 2*h*, is generated by this electromagnetic repulsion. In this electromagnetic contactor, an external magnetic field is applied so that the arcs are driven in the driving direction of the movable contactor and in the direction perpendicular to the current direction of the conductive plate of the movable contactor. Accordingly, a space sufficient for the interruption of an arc is not obtained in the direction perpendicular to the current direction, so that it is difficult to sufficiently extend an arc and to interrupt the arc.

In particular, when a large current is supplied, the electromagnetic repulsion applied to the arc is increased, so that this tendency becomes significant. When the distances between the second conductive plate portions 2*e* and 2*f* of the L-shaped conductive plate portions 2*g* and 2*h* of the fixed contactor 2 and the positions where the arcs are generated are increased, the influences on the arcs are reduced. However, the fixed contactor is formed in a large size on the outside of the movable contactor, so that the size of the device is increased.

Next, a second embodiment of the invention will be described with reference to FIG. 4.

In the second embodiment, a Lorentz force, which resists electromagnetic repulsion in a contact opening direction generated by a fixed contactor and a movable contactor, is generated on the back side of the movable contactor.

Figure 4A:
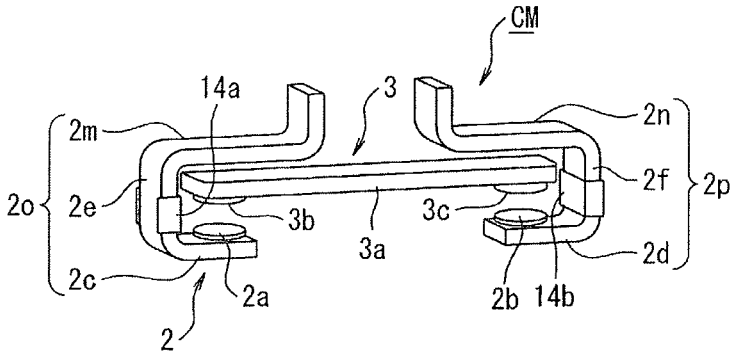
FIGS. 4(*a*)-4(*c*) are views illustrating a second embodiment of the contact mechanism of the invention, wherein FIG. 4(*a*) is a perspective view, FIG. 4(*b*) is a cross-sectional view of the contact mechanism when a contact is closed, and FIG. 4(*c*) is a cross-sectional view illustrating an arc generating state of the contact mechanism when a contact is opened.
Figure 4B:
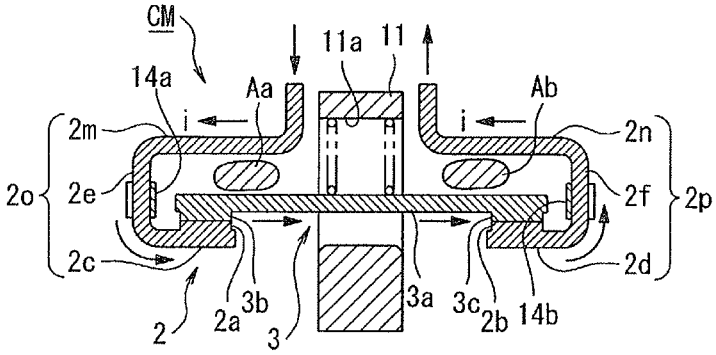
Figure 4C:
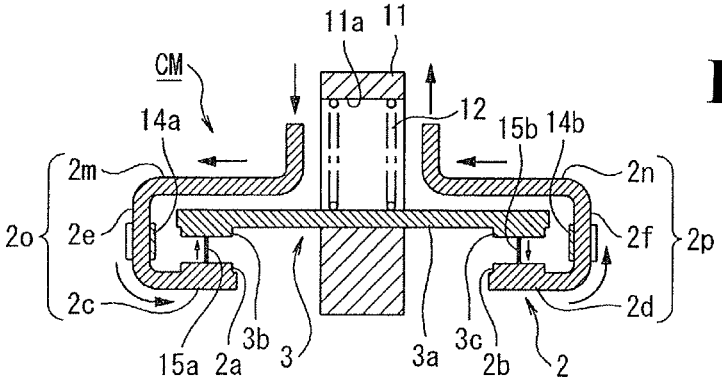

That is, the second embodiment has the same structure as the structure of the above-mentioned first embodiment except that third conductive plate portions 2*m* and 2*n* parallel to the conductive plate 3*a* are formed by bending the second conductive plate portions 2*e* and 2*f* of the L-shaped conductive plate portions 2*g* and 2*h* of the fixed contactor 2 to cover the upper end sides of the end portions of the conductive plate 3*a* of the movable contactor 3 in the structure of FIGS. 2(*a*)-2(*e*) of the above-mentioned first embodiment so that C-shaped conductive portions 2*o* and 2*p* are formed as illustrated in FIGS. 4(*a*)-4(*c*).

According to the second embodiment, when the electromagnetic coil 8 of the operating electromagnet 4 is in a non-excited state, an attractive force does not act between the fixed iron core 5 and the movable iron core 6. Accordingly, the movable iron core 6 and the contactor holder 11 are urged upward by the spring force of the return spring 9 as in the above-mentioned first embodiment, so that the contact mechanism CM is in a contact opening state as illustrated in FIG. 4(*a*).

When the electromagnetic coil 8 of the operating electromagnet 4 is excited from the contact opening state of the contact mechanism CM, an attractive force is generated by the fixed iron core 5 and the movable iron core 6 is attracted downward against the return spring 9. Accordingly, the contactor holder 11 is moved down and the movable contact portions 3*b* and 3*c* of the movable contactor 3 contact with the fixed contact portions 2*a* and 2*b* of the fixed contactor 2 with the contact pressure of the contact spring 12, so that the contact mechanism CM is in a contact closing state as illustrated in FIG. 4(*b*).

When the contact mechanism CM is in a contact closing state in this way, a large current of about, for example, several tens kA to be input from the external connection terminal 2*i* of the fixed contactor 2 connected to, for example, a DC power source (not illustrated) is supplied to the movable contact portion 3*b* of the movable contactor 3 through the third conductive plate portion 2*m*, the second conductive plate portion 2*e*, the first conductive plate portion 2*c*, and the fixed contact portion 2*a*.

The large current supplied to the movable contact portion 3*b* is supplied to the fixed contact portion 2*b* through the conductive plate 3*a* and the movable contact portion 3*c*. The large current supplied to the fixed contact portion 2*b* is supplied to the first conductive plate portion 2*d*, the second conductive plate portion 2*f*, the third conductive plate portion 2*n*, and the external connection terminal 2*j*, so that a current path along which a current is supplied to an external load is formed.

At this time, electromagnetic repulsion in the direction where the movable contact portions 3*b* and 3*c* are opened is generated between the fixed contact portions 2*a* and 2*b* of the fixed contactor 2 and the movable contact portions 3*b* and 3*c* of the movable contactor 3.

However, since the C-shaped conductive plate portions 2*o* and 2*p* of the fixed contactor 2 include the first conductive plate portions 2*c* and 2*d*, the second conductive plate portions 2*e* and 2*f*, and the third conductive plate portions 2*m* and 2*n*, currents of which the flow directions are opposite to each other flow in the third conductive plate portions 2*m* and 2*n* of the fixed contactor 2 and the conductive plate 3*a* of the movable contactor 3 facing the third conductive plate portions 2*m* and 2*n* as illustrated in FIG. 4(*b*). For this reason, it is possible to generate electromagnetic repulsion in spaces Aa and Ab between the third conductive plate portions 2*m* and 2*n* of the fixed contactor 2 and the conductive plate 3*a* of the movable contactor 3.

It is possible to generate a Lorentz force that presses the conductive plate 3*a* of the movable contactor 3 against the fixed contact portions 2*a* and 2*b* of the fixed contactor 2 by this electromagnetic repulsion. It is possible to resist electromagnetic repulsion in the contact opening direction that is generated between the fixed contact portions 2*a* and 2*b* of the fixed contactor 2 and the movable contact portions 3*b* and 3*c* of the movable contactor 3 by this Lorentz force, so that it is possible to prevent the movable contact portions 3*b* and 3*c* of the movable contactor 3 from being opened.

When the excitation of the operating electromagnet 4 is stopped from the contact closing state of the contact mechanism CM and a current is interrupted, the movable contact portions 3*b* and 3*c* of the movable contactor 3 are separated upward from the fixed contact portions 2*a* and 2*b* of the L-shaped conductive plate portions 2*g* and 2*h* of the fixed contactor 2 as illustrated in FIG. 4(*c*). At this time, arcs 15*a* and 15*b* are generated between the fixed contact portions 2*a* and 2*b* and the movable contact portions 3*b* and 3*c*. The current direction of the arc 15*a* corresponds to the contact opening direction, and the current direction of the arc 15*b* corresponds to a direction opposite to the contact opening direction.

For this reason, as in the above-mentioned first embodiment, the direction of a current, which flows in the arc 15*a* generated between the fixed contact portion 2*a* of the fixed contactor 2 and the movable contact portion 3*b* of the movable contactor 3, is opposite to the direction of a current that flows in the second conductive plate portion 2*e* of the adjacent fixed contactor 2.

For this reason, a magnetic field generated by the arc 15*a* and a magnetic field generated by the second conductive plate portion 2*e* are generated in the directions where the magnetic fields repel each other. Accordingly, when the magnetic plate 14*a* is disposed so as to cover the inner surface of the second conductive plate portion 2*e* of the fixed contactor 2 for the reduction of the repulsion, a magnetic field generated by the second conductive plate portion 2*e* is shielded. Therefore, it is possible to prevent the magnetic field from affecting the arc 15*a*. Further, likewise, it is possible to prevent the magnetic field from affecting the arc 15*b* by shielding a magnetic field, which is generated from the second conductive plate portion 2*f* of the fixed contactor 2 adjacent to the arc 15*b* generated between the fixed contact portion 2*b* and the movable contact portion 3*c*, by the magnetic plate 14*b*.

Even in the second embodiment, it is possible to generate a Lorentz force that resists electromagnetic repulsion in the contact opening direction generated between the fixed contactor 2 and the movable contactor 3 by a simple structure where the C-shaped conductive plate portions 2*o* and 2*p* are formed at the fixed contactor 2, and to reduce the influence of the magnetic fields generated from the conductor plate portions without making the conductor plate portions, which are adjacent to the arcs 15*a* and 15*b*, be distant from the arcs. Accordingly, it is possible to obtain the same effect as the effect of the above-mentioned first embodiment.

Meanwhile, a case where the magnetic plates 14*a* and 14*b* include the inner surface plate portions 14*c* covering the inner surfaces of the conductive plate portions and the side plate portions 14*d* and 14*e* extending toward the outside from both the front and rear ends of the inner surface plate portions 14*c* has been described in the first and second embodiments. However, the invention is not limited thereto and the magnetic plates 14*a* and 14*b* may be formed so as to cover the entire circumference of the conductive plate portions.

Further, a case where a new contact mechanism CM is applied to the electromagnetic contactor 1 of the above-mentioned first embodiment has been described in the second embodiment, but the invention is not limited thereto.

Figure 5:
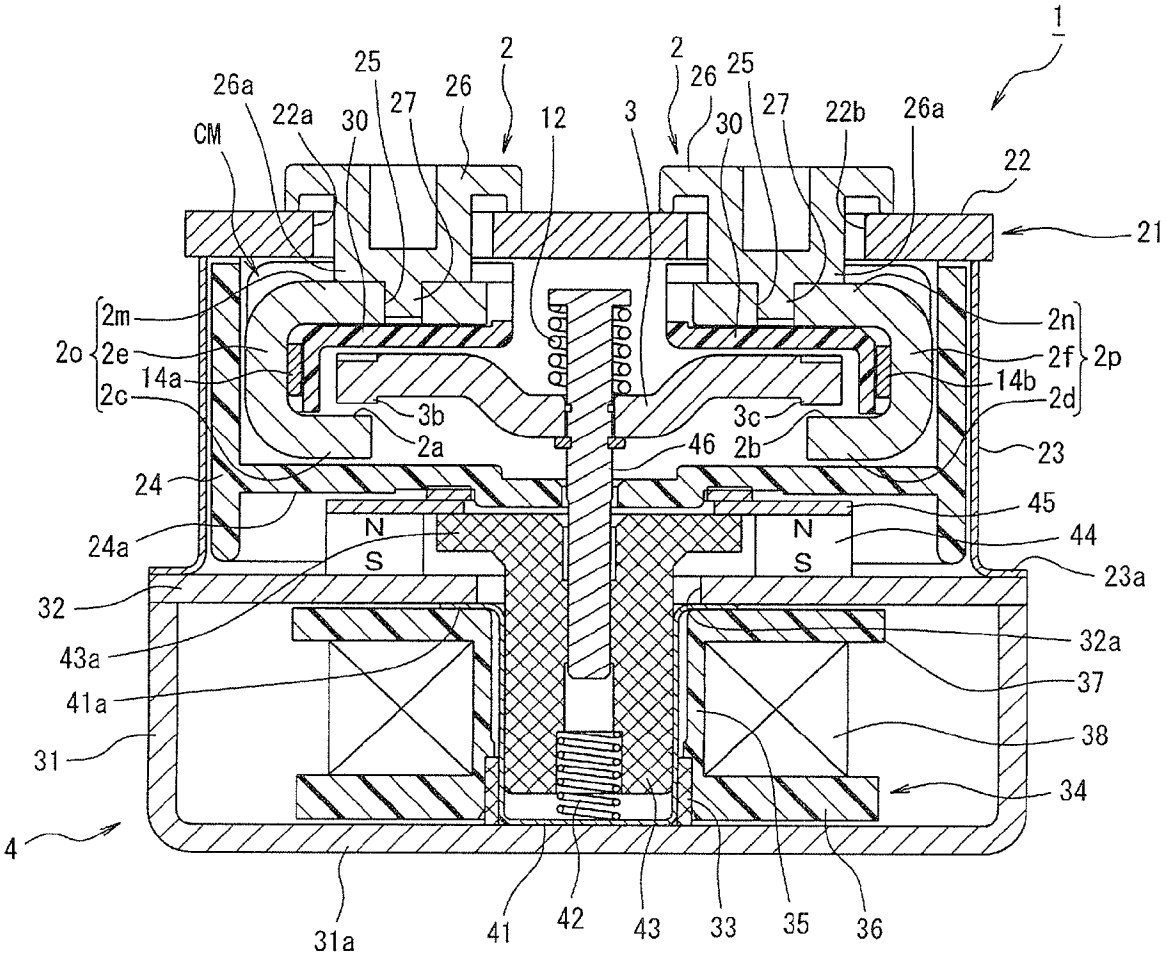
FIG. 5 is a cross-sectional view of an electromagnetic contactor that can be applied to the second embodiment.

That is, a contact mechanism CM including the C-shaped conductive plate portions 2*o* and 2*p* may be applied to an electromagnetic contactor 20 illustrated in FIG. 5. In FIG. 5, the electromagnetic contactor 20 includes a tub-like contact receiving case 21 that receives the contact mechanism CM. The contact receiving case 21 includes a fixed contact supporting-insulating substrate 22 that forms a top plate supporting the fixed contactor 2, a metal rectangular tube body 23 that is brazed to the lower surface of the fixed contact supporting-insulating substrate 22 and has conductivity, and an insulating rectangular tube body 24 that is provided on the inner peripheral surface of the metal rectangular tube body 23 and has the shape of a bottomed rectangular tube. The contact receiving case 21 is formed in the shape of a tub of which the lower surface is opened.

Further, as illustrated in FIG. 5, in the fixed contactor 2, insertion holes 25 are formed at the third conductive plate portions 2*m* and 2*n* of the C-shaped conductive plate portions 2*o* and 2*p* and pins 27 formed at conductive supporting portions 26 are inserted into the insertion holes 25 and integrally fixed to the insertion holes 25 by brazing, for example.

Meanwhile, through holes 22*a* and 22*b* into which the conductive supporting portions 26 of the fixed contactor 2 are inserted are formed in the fixed contact supporting-insulating substrate 22 at a predetermined interval in the longitudinal direction (the horizontal direction in FIG. 5), the conductive supporting portions 26 of the fixed contactor 2 are inserted into these through holes 22*a* and 22*b* from above, and the pins 27 are fitted and brazed to the insertion holes 25 of the C-shaped conductive portions 2*o* and 2*p*. Accordingly, the fixed contactor 2 is supported by the fixed contact supporting-insulating substrate 22.

Further, insulating covers 30 are fitted to small-diameter portions 26*a* of the conductive supporting portions 26 and mounted on the C-shaped conductive plate portions 2*o* and 2*p* of the fixed contactor 2 so as to cover the inner peripheral surfaces and both side surfaces of the second conductive plate portions 2*e* and 2*f* and the third conductive plate portions 2*m* and 2*n*.

Meanwhile, as illustrated in FIG. 5, the operating electromagnet 4 includes a U-shaped magnetic yoke 31 and an upper magnetic yoke 32. The U-shaped magnetic yoke 31 is flat in side view. The upper magnetic yoke 32 is fixed among upper end portions, which are open ends of the magnetic yoke 31, and has the shape of a flat plate.

A cylindrical auxiliary yoke 33 of which the height is relatively low is formed on the middle portion of a bottom plate portion 31*a* of the magnetic yoke 31. A spool 34 is disposed on the peripheral surface of the cylindrical auxiliary yoke 33.

The spool 34 includes a central cylindrical portion 35 into which the cylindrical auxiliary yoke 33 is inserted; a lower flange portion 36 that protrudes outward from the lower end portion of the central cylindrical portion 35 in a radial direction; and an upper flange portion 37 that protrudes outward from a portion of the central cylindrical portion 35 slightly below the upper end of the central cylindrical portion 35 in the radial direction. Moreover, an electromagnetic coil 38 is wound in a receiving space that is formed by the central cylindrical portion 35, the lower flange portion 36, and the upper flange portion 37.

Further, a through hole 32*a*, which faces the central cylindrical portion 35 of the spool 34, is formed at the central portion of the upper magnetic yoke 32.

Furthermore, a cap 41, which is formed in the shape of a bottomed tube and made of a non-magnetic material, is disposed on the inner peripheries of the cylindrical auxiliary yoke 33 and the central cylindrical portion 35 of the spool 34. A flange portion 41*a*, which is formed at the open end of the cap 41 so as to extend outward in the radial direction, is sealed and joined to the lower surface of the upper magnetic yoke 32. Accordingly, a sealed container where the contact receiving case and the cap 41 communicate with each other through the through hole 32*a* of the upper magnetic yoke 32 is formed. Moreover, the sealed container, which includes the contact receiving case 21 and the cap 41, is filled with gas, such as hydrogen gas, nitrogen gas, mixed gas of hydrogen and nitrogen, air, or $SF_6$.

Further, a movable plunger 43, which is provided with a return spring 42 between the bottom plate portion of the cap 41 and itself, is provided in the cap 41 so as to be slidable up and down. A peripheral flange portion 43*a*, which protrudes outward in the radial direction, is formed at the upper end portion of the movable plunger 43 that protrudes upward from the upper magnetic yoke 32.

Furthermore, a permanent magnet 44, which is formed in an annular shape, is fixed to the upper surface of the upper magnetic yoke 32 so as to surround the peripheral flange portion 43*a* of the movable plunger 43. The permanent magnet 44 is magnetized in the vertical direction, that is, the thickness direction so that, for example, an upper end portion of the permanent magnet corresponds to an N pole and a lower end portion corresponds to an S pole.

Moreover, an auxiliary yoke 45, which has the same shape as the shape of the permanent magnet 44 and includes a central opening of which the inner diameter is smaller than the outer diameter of the peripheral flange portion 43*a* of the movable plunger 43, is fixed to the upper end face of the permanent magnet 44. The peripheral flange portion 43*a* of the movable plunger 43 contacts with the lower surface of the auxiliary yoke 45.

Further, since the permanent magnet 44 is formed in an annular shape, the number of parts is reduced as compared to a case where a permanent magnet is divided into two pieces and the two pieces are disposed on the left and right sides as disclosed in, for example, JP 2-91901 A. Accordingly, cost is reduced. Furthermore, since the peripheral flange portion 43*a* of the movable plunger 43 is disposed near the inner peripheral surface of the permanent magnet 44, magnetic flux is not wasted in a closed circuit passing through the magnetic flux generated by the permanent magnet 44. Accordingly, leakage flux is reduced, so that it is possible to efficiently use the magnetic force of the permanent magnet.

Meanwhile, the shape of the permanent magnet 44 is not limited to the above-mentioned shape, and may be a quadrangular shape or the shape of a quadrangular tube. In short, as long as the shape of the inner surface of the permanent magnet corresponds to the shape of the peripheral flange portion 43*a* of the movable plunger 43, the shape of the permanent magnet may be an arbitrary shape.

Further, a connecting shaft 46, which supports the movable contactor 3 protruding upward through a through hole 24*a* formed in the bottom portion of the insulating rectangular tube body 24, is fixed to the upper end face of the movable plunger 43.

According to the structure of FIG. 5, in a release state, the movable plunger 43 is urged upward by the return spring 42 and is at a release position where the upper surface of the peripheral flange portion 43*a* contacts with the lower surface of the auxiliary yoke 45. In this state, the contact portions 3*b* and 3*c* of the movable contactor 3 are separated upward from the fixed contact portions 2*a* and 2*b* of the fixed contactor 2, so that a current is interrupted.

The peripheral flange portion 43*a* of the movable plunger 43 is attracted to the auxiliary yoke 45 by the magnetic force of the permanent magnet 44 in this release state. Accordingly, in cooperation with the urging force of the return spring 42 and the magnetic force, the movable plunger 43 is not inadvertently moved down by vibration, impact, and the like that are applied from the outside. As a result, a state where the movable plunger 43 contacts with the auxiliary yoke 45 is secured.

Further, in the release state, magnetic flux, which is generated by the electromagnetic coil 38 when the electromagnetic coil 38 is excited, passes through the peripheral flange portion 43*a* from the movable plunger 43 and reaches the upper magnetic yoke 32 through a gap between the peripheral flange portion 43*a* and the upper magnetic yoke 32. A closed magnetic circuit, which reaches the movable plunger 43 from the upper magnetic yoke 32 through the U-shaped magnetic yoke 31 and the cylindrical auxiliary yoke 33, is formed.

For this reason, it is possible to increase magnetic flux density in the gap between the lower surface of the peripheral flange portion 43*a* of the movable plunger 43 and the upper surface of the upper magnetic yoke 32. Accordingly, a larger attractive force is generated, so that the movable plunger 43 is moved down against the urging force of the return spring 42 and the attractive force of the permanent magnet 44. Therefore, the contact portions 3*a* and 3*c* of the movable contactor 3, which is connected to the movable plunger 43 by the connecting shaft 46, contacts with the pair of fixed contact portions 2*a* and 2*b* of the fixed contactor 2, so that a current path directed to the fixed contact portion 2*b* of the fixed contactor 2 from the fixed contact portion 2*a* of the fixed contactor 2 through the movable contactor 3 is formed and a current is input.

When a current is input, the lower end face of the movable plunger 43 approaches the bottom plate portion 31*a* of the U-shaped magnetic yoke 31. Accordingly, a closed magnetic circuit where magnetic flux generated by the electromagnetic coil 38 directly penetrates the upper magnetic yoke 32 from the movable plunger 43 through the peripheral flange portion 43*a*, passes through the U-shaped magnetic yoke 31 from the upper magnetic yoke 32, and directly returns to the movable plunger 43 from the bottom plate portion 31*a* is formed.

For this reason, a large attractive force acts in the gap between the peripheral flange portion 43*a* of the movable plunger 43 and the upper magnetic yoke 32 and the gap between the bottom of the movable plunger 43 and the bottom plate portion 31*a* of the magnetic yoke 31, so that the movable plunger 43 is held at a lower position. Accordingly, a state where the contact portions 3*b* and 3*c* of the movable contactor 3 connected to the movable plunger 43 by the connecting shaft 46 contact with the fixed contact portions 2*a* and 2*b* of the fixed contactor 2 is continued.

The C-shaped conductive plate portions 2*o* and 2*p* of the fixed contactor 2 include the first conductive plate portions 2*c* and 2*d*, the second conductive plate portions 2*e* and 2*f*, and the third conductive plate portions 2*m* and 2*n*. Accordingly, in the state where a current is input, currents of which the flow directions are opposite to each other flow in the third conductive plate portions 2*m* and 2*n* of the fixed contactor 2 and the conductive plate 3*a* of the movable contactor 3 facing the third conductive plate portions 2*m* and 2*n* as illustrated in the above-mentioned FIG. 4(*b*). For this reason, it is possible to generate electromagnetic repulsion in the spaces Aa and Ab between the third conductive plate portions 2*m* and 2*n* of the fixed contactor 2 and the conductive plate 3*a* of the movable contactor 3.

It is possible to generate a Lorentz force that presses the conductive plate 3*a* of the movable contactor 3 against the fixed contact portions 2*a* and 2*b* of the fixed contactor 2 by this electromagnetic repulsion. It is possible to resist electromagnetic repulsion in the contact opening direction that is generated between the fixed contact portions 2*a* and 2*b* of the fixed contactor 2 and the movable contact portions 3*b* and 3*c* of the movable contactor 3 by this Lorentz force, so that it is possible to prevent the movable contact portions 3*b* and 3*c* of the movable contactor 3 from being opened.

When the excitation of the electromagnetic coil 38 is stopped from the contact closing state of the contact mechanism CM and a current is interrupted, the movable contact portions 3*b* and 3*c* of the movable contactor 3 are separated upward from the fixed contact portions 2*a* and 2*b* of the L-shaped conductive plate portions 2*g* and 2*h* of the fixed contactor 2 as illustrated in the above-mentioned FIG. 4(*c*). At this time, arcs 15*a* and 15*b* are generated between the fixed contact portions 2*a* and 2*b* and the movable contact portions 3*b* and 3*c*. The current direction of the arc 15*a* corresponds to the contact opening direction, and the current direction of the arc 15*b* corresponds to a direction opposite to the contact opening direction.

For this reason, as in the above-mentioned first embodiment, the direction of a current, which flows in the arc 15*a* generated between the fixed contact portion 2*a* of the fixed contactor 2 and the movable contact portion 3*b* of the movable contactor 3, is opposite to the direction of a current that flows in the second conductive plate portion 2*e* of the adjacent fixed contactor 2.

For this reason, a magnetic field generated by the arc 15*a* and a magnetic field generated by the second conductive plate portion 2*e* are generated in the directions where the magnetic fields repel each other. Accordingly, when the magnetic plate 14*a* is disposed so as to cover the inner surface of the second conductive plate portion 2*e* of the fixed contactor 2 for the reduction of the repulsion, a magnetic field generated by the second conductive plate portion 2*e* is shielded. Therefore, it is possible to prevent the magnetic field from affecting the arc 15*a*. Further, likewise, it is possible to shield a magnetic field, which is generated from the second conductive plate portion 2*f* of the fixed contactor 2 adjacent to the arc 15*b* generated between the fixed contact portion 2*b* and the movable contact portion 3*c*, by the magnetic plate 14*b*. Accordingly, it is possible to prevent the magnetic field from affecting the arc 15*b*.

In addition, since the insulating covers 30 are provided on the inner peripheral surfaces of the C-shaped conductive plate portions 2*o* and 2*p* of the fixed contactor 2 in the structure of FIG. 5, it is possible to ensure insulation distances between both end portions of the movable contactor 3 and the third conductive plate portions 2*m* and 2*n* of the C-shaped conductive plate portions 2*o* and 2*p* by the insulating covers 30 and to reduce the height of the movable contactor 3 in the movable direction at the C-shaped conductive plate portions 2*o* and 2*p*. Accordingly, it is possible to reduce the size of the contact mechanism CM.

Moreover, the operating electromagnet 4 includes the magnetic yoke 31 and the upper magnetic yoke 32, the spool 34 around which the electromagnetic coil 38 is wound, the movable plunger 43, the permanent magnet 44 that covers the peripheral flange portion 43*a* of the movable plunger 43 that protrudes from the upper magnetic yoke 32, and the auxiliary yoke 45. Accordingly, it is possible to reduce the height of the movable plunger 43 in the movable direction as the structure of a polarized electromagnet, so that it is possible to reduce the size of the operating electromagnet 4.

Meanwhile, a case where the contact receiving case 21 includes the fixed contact supporting-insulating substrate 22, the metal rectangular tube body 23, and the insulating rectangular tube body 24 has been described in the structure of FIG. 5. However, the contact receiving case 21 is not limited thereto, and may be formed by forming a tub-like body, of which the lower surface is opened, with an insulating material such as ceramics and fixing a metal rectangular tube body to the open end face of the tub-like body by brazing or the like.

Next, a third embodiment of the invention will be described with reference to FIGS. 6(*a*)-6(*c*).

In the third embodiment, C-shaped bent portions are formed at a movable contactor in contrast to the above-mentioned second embodiment.

Figure 6A:
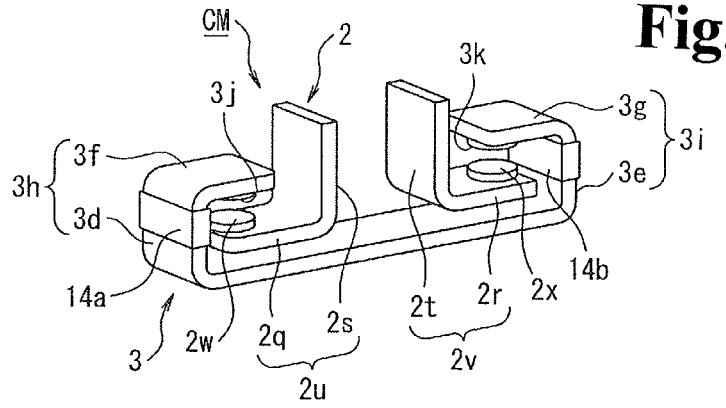
FIGS. 6(*a*)-6(*c*) are views illustrating a third embodiment of the contact mechanism of the invention, wherein FIG. 6(*a*) is a perspective view, FIG. 6(*b*) is a cross-sectional view of the contact mechanism when a contact is closed, and FIG. 6(*c*) is a cross-sectional view illustrating an arc generating state of the contact mechanism when a contact is opened.
Figure 6B:
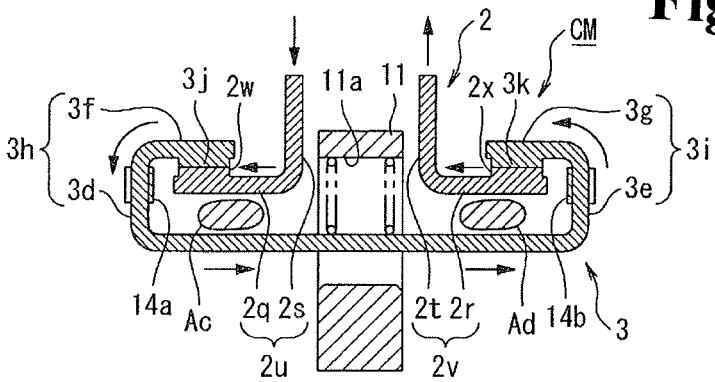
Figure 6C:
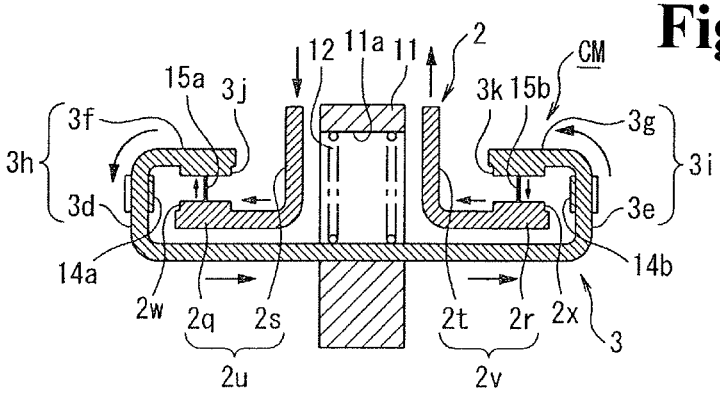

That is, in the third embodiment, as illustrated in FIGS. 6(*a*) to 6(*c*), C-shaped bent portions 3*h* and 3*i*, which are bent above a conductive plate 3*a*, include first conductive plate portions 3*d* and 3*e* that extend upward from both end portions of a conductive plate 3*a* of a movable contactor 3, and second conductive plate portions 3*f* and 3*g* that extend inward from the upper ends of the first conductive plate portions 3*d* and 3*e*. Movable contact portions 3*j* and 3*k* are formed on the lower surfaces of the front end portions of the second conductive plate portions 3*f* and 3*g* of these C-shaped bent portions 3*h* and 3*i*.

Further, L-shaped conductive plate portions 2*u* and 2*v* of a fixed contactor 2 include fourth conductive plate portions 2*q* and 2*r* and fifth conductive plate portions 2*s* and 2*t*. The fourth conductive plate portions 2*q* and 2*r* face gaps between the conductive plate 3*a* and the second conductive plate portions 3*f* and 3*g* of the C-shaped bent portions 3*h* and 3*i* of the movable contactor 3 when the contact mechanism CM is in a contact opening state. The fourth conductive plate portions 2*q* and 2*r* extend inward. The fifth conductive plate portions 2*s* and 2*t* extend upward from the inner ends of these fourth conductive plate portions 2*q* and 2*r* while passing by the inside of inner end portions of the C-shaped bent portions 3*h* and 3*i* of the movable contactor 3. Furthermore, fixed contact portions 2*w* and 2*x* are formed on the fourth conductive plate portions 2*q* and 2*r* at the positions that face the movable contact portions 3*j* and 3*k* of the movable contactor 3.

Moreover, magnetic plates 14*a* and 14*b* are fixedly disposed so as to cover the inner surfaces of the first conductive plate portions 3*d* and 3*e* of the movable contactor 3. The respective magnetic plates 14*a* and 14*b* are disposed at the positions, which face gaps between the fixed contact portions 2*w* and 2*x* and the movable contact portions 3*j* and 3*k* above the first conductive plate portions 3*d* and 3*e* in the contact closing state, so as to cover the peripheries of the first conductive plate portions 3*d* and 3*e*.

According to the third embodiment, when the electromagnetic coil 8 of the operating electromagnet 4 is in a non-excited state, the movable iron core 6 is moved up by the return spring 9 and is at a position where the contactor holder 11 contacts with the stopper 13. At this time, the conductive plate 3*a* of the movable contactor 3 of the contact mechanism CM contacts with the bottom portion of the insertion hole 11*a* due to the contact spring 12 as illustrated in FIG. 6(*c*). Further, the fourth conductive plate portions 2*q* and 2*r* of the fixed contactor 2 are positioned between the conductive plate 3*a* and the second conductive plate portions 3*f* and 3*g* of the C-shaped bent portions 3*h* and 3*i* and the fixed contact portions 2*w* and 2*x* are separated downward from the movable contact portions 3*j* and 3*k*, so that the contact mechanism is in a contact closing state.

When the electromagnetic coil 8 of the operating electromagnet 4 is excited from the contact opening state of the contact mechanism CM, the movable iron core 6 is attracted against the return spring 9 by the fixed iron core 5, and thus the contactor holder 11 is moved down. For this reason, the contact mechanism CM is in a contact closing state where the movable contact portions 3*j* and 3*k* of the movable contactor 3 contact with the fixed contact portions 2*w* and 2*x* of the fixed contactor 2 as illustrated in FIG. 6(*b*).

When the contact mechanism CM is in a contact closing state in this way, a large current of about, for example, several tens kA to be input from the external connection terminal 2*i* of the fixed contactor 2 connected to, for example, a DC power source (not illustrated) is supplied to the movable contact portion 3*j* of the movable contactor 3 through the fifth conductive plate portion 2*s*, the fourth conductive plate portion 2*q*, and the fixed contact portion 2*w*. The large current supplied to the movable contact portion 3*j* is supplied to the fixed contact portion 2*x* through the second conductive plate portion 3*f*, the first conductive plate portion 3*d*, the conductive plate 3*a*, the first conductive plate portion 3*e*, the second conductive plate portion 3*g*, and the movable contact portion 3*k*. A current path along which the large current supplied to the fixed contact portion 2*x* is supplied to an external load through the fourth conductive plate portion 2*r*, the fifth conductive plate portion 2*t*, and the external connection terminal 2*j* is formed.

At this time, electromagnetic repulsion in the direction where the movable contact portions 3*j* and 3*k* are opened is generated between the fixed contact portions 2*w* and 2*x* of the fixed contactor 2 and the movable contact portions 3*j* and 3*k* of the movable contactor 3.

However, since the C-shaped bent portions 3*h* and 3*i* of the movable contactor 3 include the conductive plate 3*a*, the first conductive plate portions 3*d* and 3*e*, and the second conductive plate portions 3*f* and 3*g* as illustrated in FIG. 5, currents of which the flow directions are opposite to each other flow in the conductive plate 3*a* of the movable contactor 3 and the fourth conductive plate portions 2*q* and 2*r* of the fixed contactor 2.

For this reason, as illustrated in FIG. 6(*b*), it is possible to generate a Lorentz force, which presses the movable contact portions 3*j* and 3*k* of the movable contactor 3 against the fixed contact portions 2*w* and 2*x* of the fixed contactor 2, by making electromagnetic repulsion act in spaces Ac and Ad between the conductive plate 3*a* of the movable contactor 3 and the fourth conductive plate portions 2*q* and 2*r* of the fixed contactor 2. It is possible to resist electromagnetic repulsion in the contact opening direction that is generated between the fixed contact portions 2*w* and 2*x* of the fixed contactor 2 and the movable contact portions 3*j* and 3*k* of the movable contactor 3 by this Lorentz force, so that it is possible to prevent the movable contact portions 3*j* and 3*k* of the movable contactor 3 from being opened when a large current is applied.

Moreover, since the L-shaped conductive plate portions 2*u* and 2*v* are formed at the fixed contactor 2 in the third embodiment, magnetic flux-intensification portions are formed above the second conductive plate portions 3*f* and 3*g* of the movable contactor 3 by the fifth conductive plate portions 2*s* and 2*t* of the L-shaped conductive plate portions 2*u* and 2*v*. Accordingly, it is also possible to generate the same Lorentz force as the Lorentz force of the above-mentioned first embodiment, so that it is possible to more reliably prevent the movable contactor 3 from being opened.

When the excitation of the operating electromagnet 4 is stopped from the contact closing state of the contact mechanism CM and a current is interrupted, the movable contact portions 3*j* and 3*k* of the movable contactor 3 are separated upward from the fixed contact portions 2*w* and 2*x* of the L-shaped conductive plate portions 2*u* and 2*v* of the fixed contactor 2 as illustrated in FIG. 6(*c*). At this time, arcs 15*a* and 15*b* are generated between the fixed contact portions 2*w* and 2*x* and the movable contact portions 3*j* and 3*k*. The current direction of the arc 15*a* corresponds to the contact opening direction, and the current direction of the arc 15*b* corresponds to a direction opposite to the contact opening direction.

If the external connection terminal 2*i* is connected to a positive (+) electrode terminal and the external connection terminal 2*j* is connected to a negative (−) electrode terminal at this time, the L-shaped conductive plate portion 2*u* of the fixed contactor 2 has a positive polarity and the L-shaped conductive plate portion 2*v* has a negative polarity. As a result, the current direction of the arc 15*a*, which is generated between the fixed contact portion 2*w* of the L-shaped conductive plate portion 2*u* and the movable contact portion 3*j* of the movable contactor 3, corresponds to a direction that is directed to the movable contact portion 3*j* from the fixed contact portion 2*w* as illustrated in FIG. 6(*c*). Further, the direction of a current flowing in the first conductive plate portion 3*d* of movable contactor 3 adjacent to the arc 15*a* corresponds to an opposite direction.

For this reason, magnetic fields, which are generated by the arc 15*a* and the first conductive plate portion 3*d*, are generated in the directions where the magnetic fields repel each other. Accordingly, the magnetic plate 14*a* is disposed so as to cover the periphery of the first conductive plate portion 3*d* of the movable contactor 3 for the reduction of the repulsion. Therefore, a magnetic field generated by the first conductive plate portion 3*d* is reliably shielded, so that it is possible to prevent the magnetic field of the first conductive plate portion 3*d* from affecting the arc 15*a*.

Likewise, the magnetic plate 14*b*, which covers the periphery of the first conductive plate portion 3*e*, is disposed so as to reduce the influence of the magnetic field, which is generated from the first conductive plate portion 3*e* of the movable contactor 3 adjacent to the arc 15*b* generated between the fixed contact portion 2*x* of the fixed contactor 2 and the movable contact portion 3*k*, on the arc 15*b*. Accordingly, the magnetic field generated by the first conductive plate portion 3*e* is reliably shielded, so that the magnetic field generated by the first conductive plate portion 3*e* does not affect the arc 15*b*.

Therefore, even in the third embodiment, it is possible to reduce the influence of the magnetic fields generated from the conductor plate portions without making the conductor plate portions, which are adjacent to the arcs, be distant from the arcs as in the above-mentioned first and second embodiments. For this reason, it is possible to stably extend the arcs in an aimed direction and to interrupt the arcs without increasing the size of the device.

Even in the third embodiment, it is possible to generate a Lorentz force that resists electromagnetic repulsion in the contact opening direction generated between the fixed contactor 2 and the movable contactor 3, and to suppress the influence of the magnetic fields, which are generated from the conductive plate portions without making the conductor plate portions adjacent to the arcs be distant from the arcs, on the arcs. Accordingly, it is possible to obtain the same effect as the effect of the above-mentioned first and second embodiments.

Meanwhile, a case where the magnetic plates 14*a* and 14*b* are disposed at the positions, which face gaps between the fixed contact portions 2*w* and 2*x* and the movable contact portions 3*j* and 3*k* above the first conductive plate portions 3*d* and 3*e* in the contact closing state, so as to cover the peripheries of the first conductive plate portions 3*d* and 3*e* has been described in the third embodiment. However, as in the above-mentioned first and second embodiments, the magnetic plates 14*a* and 14*b* may be disposed so as to cover the inner surfaces, the front surfaces, and the rear surfaces of the first conductive plate portions 3*d* and 3*e*.

In the third embodiment, the fourth conductive plate portions 2*s* and 2*t* of the L-shaped conductive plate portions 2*u* and 2*v* of the fixed contactor 2 are more distant from the arcs 15*a* and 15*b* than the first conductive plate portions 3*d* and 3*e* of the movable contactor 3. However, since the second conductive plate portions 2*s* and 2*t* approach the arcs 15*a* and 15*b*, the magnetic plates 14*a* and 14*b* may be fixedly disposed on the second conductive plate portions 2*s* and 2*t*.

Further, cases where the contact mechanism CM of the invention is applied to an electromagnetic contactor have been described in the above-mentioned embodiments. However, the invention is not limited thereto, and the contact mechanism CM of the invention may be applied to an arbitrary device such as a switch.

INDUSTRIAL APPLICABILITY

According to the invention, it is possible to provide a contact mechanism that can suppress electromagnetic repulsion opening a movable contactor at the time of the application of a current without the increase of the size of the entire structure and is adapted to improve arc-extinguishing performance, and an electromagnetic contactor using the contact mechanism.

EXPLANATIONS OF LETTERS OR NUMERALS

1: body case
1*a*: upper case
1*b*: lower case
CM: contact mechanism
2: fixed contact
2*a*, 2*b*: fixed contact portion
2*c*, 2*d*: first conductive plate portion
2*e*, 2*f*: second conductive plate portion
2*g*, 2*h*: L-shaped conductive plate portion
2*i*, 2*j*: external connection terminal
2*m*, 2*n*: third conductive plate portion
2*o*, 2*p*: C-shaped conductive plate portion
2*q*, 2*r*: fourth conductive plate portion
2*s*, 2*t*: fifth conductive plate portion
2*u*, 2*v*: L-shaped conductive plate portion
2*w*, 2*x*: fixed contact portion
3: movable contactor
3*a*: conductive plate
3*b*, 3*c*: movable contact portion
3*d*, 3*e*: first conductive plate portion
3*f*, 3*g*: second conductive plate portion
3*h*, 3*i*: C-shaped bent portion
3*j*, 3*k*: movable contact portion
4: operating electromagnet
5: fixed iron core
6: movable iron core
8: electromagnetic coil
9: return spring
11: contactor holder
12: contact spring
13: stopper
14*a*, 14*b*: magnetic plate
15*a*, 15*b*: arc
21: contact receiving case
22: fixed contact supporting-insulating substrate
23: metal rectangular tube body
24: insulating rectangular tube body
30: insulating cover
31: magnetic yoke
32: upper magnetic yoke
33: cylindrical auxiliary yoke
34: spool
38: electromagnetic coil
41: cap
42: return spring
43: movable plunger
43*a*: peripheral flange portion
44: annular permanent magnet
45: auxiliary yoke
46: connecting shaft

What is claimed is:

1. A contact mechanism where a shape of at least one of a fixed contactor including a pair of fixed contact portions and a movable contactor including a pair of movable contact portions capable of contacting with and separating from the pair of fixed contact portions is set to a shape that generates a Lorentz force resisting electromagnetic repulsion in a contactor opening direction generated between the fixed contact portions and the movable contact portions when a current is applied, the fixed contactor and the movable contactor being inserted in a current path, wherein the fixed contactor further comprises a pair of conductive plate portions each including:

a first conductive plate portion supporting the fixed contact portion and extending in parallel outwardly toward an end portion of the movable contactor, a second conductive plate portion extending from an outer end portion of the first conductive plate portion passing an outer side of the end portion of the movable contactor, and a third conductive plate portion extending inwardly from an end portion of the second conductive plate portion in parallel with the movable contactor to form a C-shape, wherein the movable contactor further comprises a conductive plate disposed between the first conductive plate portions and the third conductive plate portions of the pair of conductive plate portions, the movable contact portions are disposed on a surface of two end portions of the conductive plate, respectively, and wherein magnetic bodies are disposed on at least one of the fixed contactor and the movable contactor for suppressing a force driving arcs, which are generated between the pair of fixed contact portions and the pair of movable contact portions, to the fixed contactor on an opposite side, the magnetic bodies are disposed to cover at least portions of the second conductive plate portions facing the fixed contact portions.

2. An electromagnetic contactor comprising:

a contact mechanism according to claim 1, wherein the movable contactor is connected to a movable iron core of an operating electromagnet and the fixed contactor is connected to an external connection terminal.

3. A contact mechanism according to claim 1, wherein the fixed contactor further comprises a pair of conductive plate portions each including:

a first conductive plate portion supporting the fixed contact portion and extending in parallel outwardly toward an end portion of the movable contactor, and a second conductive plate portion extending from an outer end portion of the first conductive plate portion passing an outer side of the end portion of the movable contactor.

4. A contact mechanism according to claim 3, wherein each of the pair of conductive plate portions of the fixed contactor further comprises a third conductive plate portion extending inwardly from an end portion of the second conductive plate portion in parallel with the movable contactor to form a C-shape.

5. A contact mechanism according to claim 4, wherein the movable contactor further comprises a conductive plate disposed between the first conductive plate portion and the third conductive plate portion of each of the pair of conductive plate portions, the movable contact portions are disposed on a surface of two end portions of the conductive plate, respectively, and the magnetic bodies are disposed to cover at least portions of the second conductive plate portions facing the fixed contact portions.

6. A contact mechanism comprising:

a fixed contactor including a pair of fixed contact portions;

a movable contactor including a pair of movable contact portions contacting with and separating from the pair of fixed contact portions, the fixed contactor and the movable contactor being inserted in a current path;

an operating electromagnet connected to the movable contactor for driving the movable contactor; and magnetic bodies disposed on at least one of the fixed contactor and the movable contactor for suppressing a force driving arcs, which are generated between the pair of fixed contact portions and the pair of movable contact portions, to the fixed contactor on the opposite side, wherein a shape of at least one of the fixed contactor and the movable contactor is set to a shape that generates a Lorentz force resisting electromagnetic repulsion in a contactor opening direction generated between the fixed contact portions and the movable contact portions when a current is applied, wherein the fixed contactor further comprises a pair of conductive plate portions each including:

a first conductive plate portion supporting the fixed contact portion and extending in parallel outwardly toward an end portion of the movable contactor, a second conductive plate portion extending from an outer end portion of the first conductive plate portion passing an outer side of the end portion of the movable contactor, and a third conductive plate portion extending inwardly from an end portion of the second conductive plate portion in parallel with the movable contactor to form a C-shape, wherein the movable contactor further comprises a conductive plate disposed between the first conductive plate portions and the third conductive plate portions of the pair of conductive plate portions, the movable contact portions are disposed on a surface of two end portions of the conductive plate, respectively, and the magnetic bodies are disposed to cover at least portions of the second conductive plate portions facing the fixed contact portions.

* * * * *

UNITED STATES PATENT AND TRADEMARK OFFICE

CERTIFICATE OF CORRECTION

PATENT NO. : 8,816,801 B2
APPLICATION NO. : 13/878353
DATED : August 26, 2014
INVENTOR(S) : Hiroyuki Tachikawa et al.

It is certified that error appears in the above-identified patent and that said Letters Patent is hereby corrected as shown below:

In the Specification

Please change column 12, line 55, from "... case and the cap 41..." to -- case 21 and the cap 41 --.

Signed and Sealed this
Seventeenth Day of February, 2015

Michelle K. Lee

Michelle K. Lee
*Deputy Director of the United States Patent and Trademark Office*